United States Patent [19]

Rosman

[11] Patent Number: 4,639,189

[45] Date of Patent: Jan. 27, 1987

[54] HOLLOW, THERMALLY-CONDITIONED, TURBINE STATOR NOZZLE

[75] Inventor: Irwin E. Rosman, Woodland Hills, Calif.

[73] Assignee: Rockwell International Corporation, El Segundo, Calif.

[21] Appl. No.: 584,039

[22] Filed: Feb. 27, 1984

[51] Int. Cl.[4] ..... F01D 5/18; F01D 25/08; F01D 9/04

[52] U.S. Cl. ..... 415/115; 415/137; 415/138; 415/139; 415/217; 415/200

[58] Field of Search ..... 415/216, 217, 218, 115, 415/134, 136, 137, 138, 139, 117, 116, 177, 176, 191, 108, 178, 200; 60/39.75, 39.83, 39.091, 39.14

[56] References Cited

U.S. PATENT DOCUMENTS

| | | | |
|---|---|---|---|
| 2,402,418 | 6/1946 | Kroon | 415/136 |
| 2,625,367 | 1/1953 | Rainbow et al. | 415/115 |
| 2,847,185 | 8/1958 | Petrie et al. | 415/115 |
| 3,365,124 | 1/1968 | Burge et al. | 415/115 |
| 3,735,593 | 5/1973 | Howell | 415/115 |
| 3,843,279 | 10/1974 | Crossley et al. | 415/217 |
| 4,017,213 | 4/1977 | Przirembel | 415/115 |
| 4,117,669 | 10/1978 | Heller | 415/116 |
| 4,384,822 | 5/1983 | Schweikl et al. | 415/115 |

FOREIGN PATENT DOCUMENTS

| | | | |
|---|---|---|---|
| 0723505 | 2/1955 | United Kingdom | 415/217 |
| 0918692 | 2/1963 | United Kingdom | 415/216 |

*Primary Examiner*—Robert E. Garrett
*Assistant Examiner*—H. Edward Li
*Attorney, Agent, or Firm*—H. Fredrick Hamann; Harry B. Field; Lawrence N. Ginsberg

[57] ABSTRACT

A hollow thermally-conditioned turbine stator nozzle 12 is set forth to distribute and guide combustion gases from a forward inlet 15 to the turbine rotor blades 18. The nozzle includes a plurality of vanes 20 arranged annularly in the turbine. Each vane 20 has a body 22 to guide the fluid, the body being supported by outer and inner ends 34,64. The outer and inner ends each have a forward lug 44,74 and a rear lug 46,76. A floating support is provided for the vanes and includes forward shoulders 110,136 to engage the forward lugs and prevent rearward movement of the vanes and rear shoulders 114,142 having notches 116,144 to receive and confine the tangential movement of the vanes. Each vane also includes a hollow core 152 to pass a portion of fluid and reduce thermal stresses on the vane. The vane is preferably made of silicon nitride ceramic.

17 Claims, 6 Drawing Figures

Fig. 1.
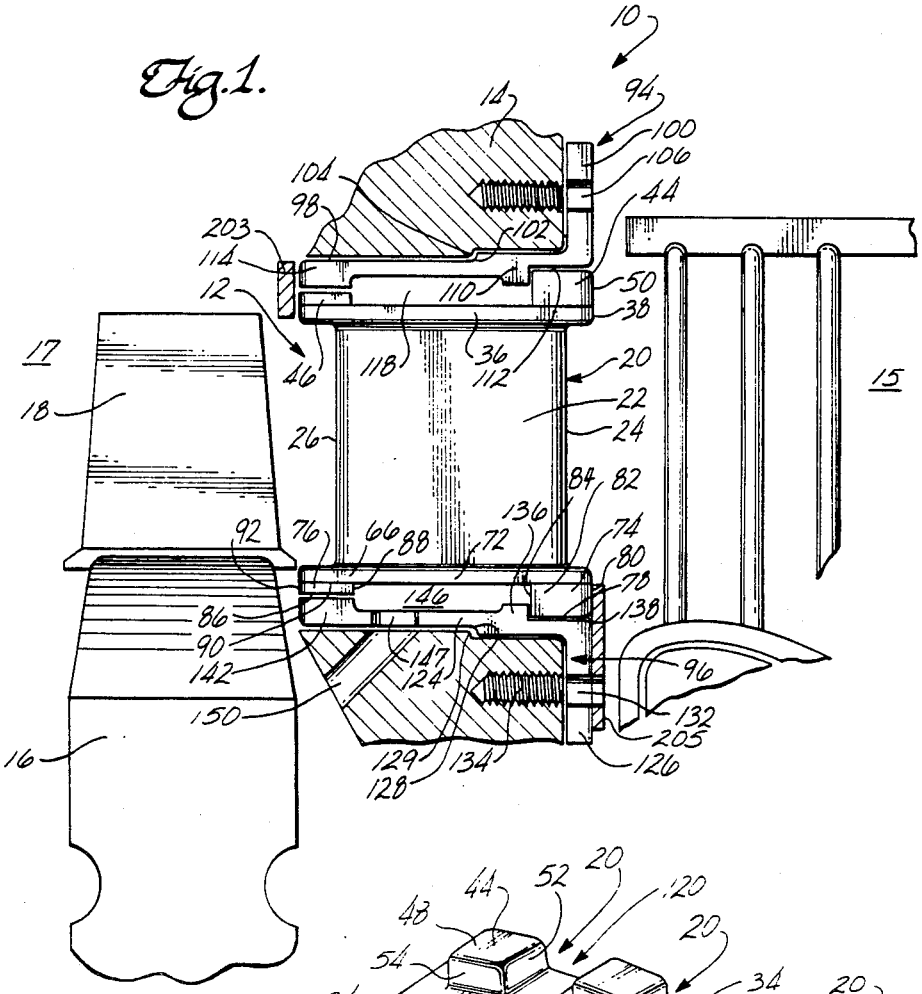
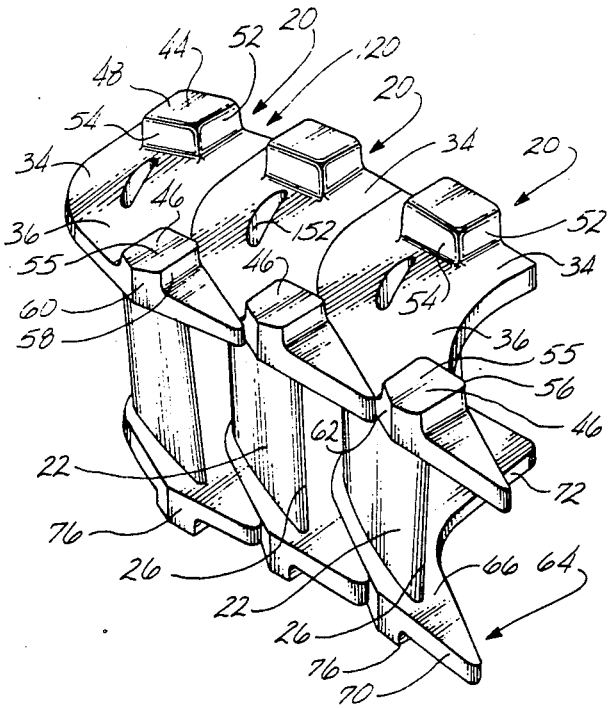
Fig. 2.

HOLLOW, THERMALLY-CONDITIONED, TURBINE STATOR NOZZLE

FIELD OF THE INVENTION

This invention relates to high temperature turbines and more particularly to high temperature turbine stator nozzles.

BACKGROUND OF THE INVENTION

As is well known, turbines have a shaft with a rotor mounting a number of rotor blades. When a fluid, such as a gas, passes across the rotor blades, the rotor and connected shaft rotates and produces useful work such as driving a compressor or the like.

One example of a turbine is a gas turbine wherein combustion gases from one or more combustion chambers flow past the rotor blades to rotate the shaft which, in turn, drives an axial air compressor. The compressed air from the air compressor is supplied to the combustion chamber for mixing with fuel for combustion. Another example of a turbine is a turbo-compressor. In rocket engines, compressed gases such as oxygen and hydrogen are mixed in a combustion chamber, reacting explosively to create high temperature gases which are exhausted through the rocket nozzle to produce thrust. A portion of the exhaust gases is directed to one or more turbo-compressors. As with the gas turbines described above, the turbo-compressors have a rotating shaft mounting a rotor with a number of rotor blades. The exhaust gases are directed to the blades to rotate the rotor and shaft to drive a compressor to compress the hydrogen or oxygen for delivery to the combustion chamber.

To guide the combustion gases to the blades, turbines, and more particularly turbo-compressors, include an annular, stationary stator nozzle. The stator nozzle typically has a number of vanes spaced and shaped to distribute and direct the flowing gases in the desired manner to the rotor blades. As can be appreciated, the stator nozzle must be capable of withstanding the high temperatures of the combustion gases. Furthermore, at start-up when the turbocompressor is cold, the nozzle must be capable of either withstanding or means must be provided for minimizing thermal stresses produced when the hot gases encounter the relatively cold stator nozzle vanes. Along these same lines, it is often practiced that the rocket engine nozzle and turbo-compressor are quenched with cryogenic gas when the rocket engine is shut down. The cryogenic gas may be at temperatures at or about −380° F. (80° R.). Again, the stator nozzle must be capable of withstanding or means must be provided for minimizing the thermal stresses when the −380° F. (80° R.) gas encounters the hot, for example, 2040° F. (2500° R.), stator nozzle.

It has been known to provide exotic materials and production methods to produce stator nozzles capable of withstanding the temperatures and thermal-stresses set forth above. This, however, has resulted in expensive stator nozzles which still are subject to failure due to the extreme environment in which they operate.

In addition to the thermal stresses attributed to temperature differentials, the vanes are also subjected to external forces. One source of such external forces are those reaction forces resulting from the flowing gases encountering and being turned by the vanes which are held by suitable supports. The vanes must be able to withstand these forces. Another source of forces being loaded upon is attributable to the vane supports. Typically, the vanes are secured to the supports at either end against both axial and tangential movement. Due to misalignment of these supports, occurring during assembly, or during operation because of thermal expansion or creep or the extreme operating pressures bending or compressive loads may be imposed on the vanes. Furthermore, misalignment of the vanes may cause the reaction forces to unevenly load the stator vanes. The potential for bending and/or compression loading, and an uneven loading of reaction forces has caused certain materials, such as ceramics which are relatively inexpensive but brittle, to be overlooked as materials for manufacturing the stator nozzle vanes. There is, therefore, a need for a means to support the stator nozzle vanes to assure that the vanes will not be subject to bending or compressive forces and that regardless of misalignment, the reaction forces will be equally distributed at the ends of the vanes.

SUMMARY OF THE INVENTION

There is, therefore, provided in the practice of this invention according to the presently preferred embodiment, a stator nozzle for a turbine consisting of a plurality of vanes stacked one against the other annularly about the turbine shaft. Each vane has a body adapted to be disposed in and direct the flow of combustion gases from a forward inlet to the turbine rotor blades. To minimize thermal stresses, each vane has a hollow core extending therethrough. During operation, a portion of the hot combustion gases, or cryogenic quenching gases, as the case may be is passed through the hollow core thereby minimizing the thermal stresses.

To provide for the equal distribution of reaction forces, for the prevention of imposition of bending or compressive forces regardless of support misalignment or movement and to provide means for passing gas through the vanes, the body of each vane has a first end and a second end, each with a forward lug and a rear lug. A floating support is provided to hold each vane and includes outer and inner annularly spaced forward shoulders. The outer and inner forward shoulders abut the forward lugs to prevent the vane from moving rearwardly. The floating support also includes annularly spaced rear shoulders having grooves to receive the rear lugs of each vane and restrain tangential movement of the vanes. Accordingly, when the vanes are loaded by the forces resulting from impinging combustion gases, the rearward axial component of the force is evenly distributed between the forward lugs of the first and second ends of each vane. At the same time, the lateral tangential component of the reaction force is evenly distributed between the rear lugs of the first and second ends of each vane. Should the first and second supports become misaligned, the vanes will adjust due to the floating support in a manner to equalize the axial and tangential loading on the lugs.

Furthermore, the movement of the vanes to adjust to the misalignment of the first and second supports does not result in bending or compressive forces being imposed on the vanes by virtue of the floating support.

Since thermal stresses have been minimized, and means are provided to support the vanes in a manner so as to avoid bending and compressive forces and to evenly distribute reaction loading on the vanes in the event of misalignment, the stator nozzle vanes may be constructed from injection-molded ceramic, such as a silicon nitride ceramic, as well as injection-molded cast or machine refractory metal, for example, columbium or a cast or machined super-alloy such as Mar-M-247.

BRIEF DESCRIPTION OF THE DRAWINGS

These and other features and advantages of the present invention will be appreciated as the same becomes better understood by reference to the following detailed description of the presently preferred embodiment when considered in connection with the accompanying drawings wherin:

FIG. 1 is a partial section view of a portion of a turbo-compressor;

FIG. 2 is a perspective view of several vanes of the stator nozzle shown booked together;

DETAILED DESCRIPTION

Figure 3:
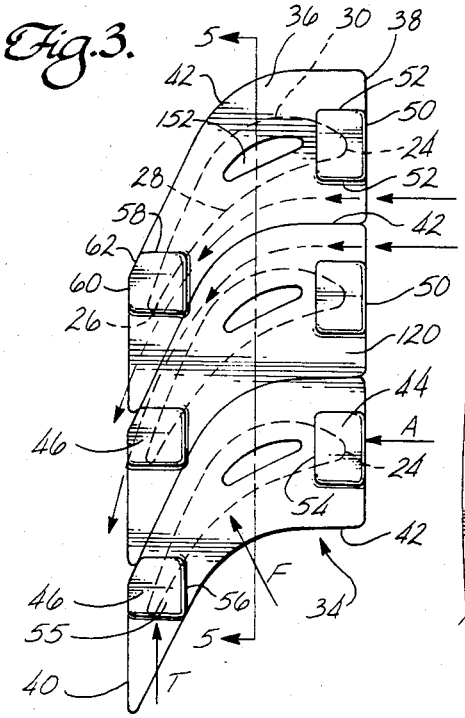
FIG 3 is a top view of the vanes of the stator nozzle.

Turning to the drawings, FIG. 1 shows in detail a portion of a turbine, and more particularly a turbo-compressor 10 for a rocket engine incorporating a stator nozzle 12 according to the present invention. The turbo-compressor 10 has a housing 14, only a portion of which is shown in FIG. 1. At a forward location on the housing 14, there is disposed an annular inlet 15 which admits the turbine driving fluid such as combustion gases or cryogenic quenching gases. It is to be understood that while the inlet 15 is referred to as being forwardly located, forward does not necessarily mean forward with respect to the rocket. As often is the case, the housing 14 may face rearwardly in relation to the rocket.

Typically, one or more turbo-compressors 10 are provided on a rocket to compress one of the rocket fuel gases such as hydrogen or oxygen. The compressed fuel gases are delivered to the rocket engine combustion chamber (not shown) where they burn and are exhausted through the rocket engine nozzle producing thrust. The temperature of the exhaust gases are, for a hydrogen-oxygen engine, on the order of 2040° F. (2500° R.). A portion of the exhaust gases from the rocket engine is directed to the inlet 15 to drive the turbo-compressor 10.

The turbo-compressor 10 has a rotating drive shaft (not shown), the axis of which defines the center line of the turbo-compressor 10 for purposes of this description. The drive shaft is coupled to and drives the compressor portion of the turbo-compressor 10. Typically, the turbo-compressor 10 is an axial compressor. Accordingly, rotation of the shaft rotates the axial compressor to compress the hydrogen or oxygen gas for delivery to the combustion chamber.

To rotate the shaft, a rotor 16 is housed within a housing space 17 and is connected to the shaft. The rotor 16 mounts a plurality of annularly arranged rotor blades 18. Exhaust gases impinge against the blades 18 in the turbo-compressor 10 to rotate the rotor 16 and shaft to drive the turbo-compressor 10.

To guide and distribute the combustion gases to the rotor blades 18, the stator nozzle 12 is disposed between the rotor blades 18 and inlet 15. The stator nozzle 12 is annularly disposed in the turbo-compressor 10 with respect to the compressor center line and is positioned in the path of the exhaust gases entering the inlet 15. The stator nozzle 12 includes a number of nozzle vanes 20 positioned side-by-side as best shown in FIG. 2. Each vane 20 has a wing-shaped body 22 with a longitudinal axis arranged radially with respect to the center line of the turbo-compressor 10, the body 22 having a longitudinally extending leading edge 24 disposed nearest the inlet 15 and a rearwardly disposed trailing edge 26. First and second vane surfaces 28 and 30 extend between the leading edge 24 and the trailing edge 26 to distribute and direct the combustion gases by turning it from the axial direction for impingement against the blades 18 as shown in FIG. 3. The impingement and turning of the combustion gases produces a reaction force against the vane body 22 as indicated by arrow F in FIG. 3.

As can be appreciated, the thermal stresses upon the turbo-compressor 10 created by the sudden, almost instantaneous subjection to an environment of 2040° F. (2500° R.) are severe.

Furthermore, thermal expansion of the housing 14 or associated components of the stator nozzle 12 may tend to cause the vanes and supporting structure to shift, which, in turn can impose bending or compression forces on the vanes (hereinafter collectively referred to as external loading). Additionally, movement of the vanes may tend to result in the uneven distribution of reaction forces imposed on the vane by the flowing gases. It has been known to provide vanes fashioned from exotic materials adapted to withstand thermal stresses and external loading. However, repeated on-off operation of the rocket engine has resulted in failure of the vanes sometimes after relatively few cycles.

Figure 4:
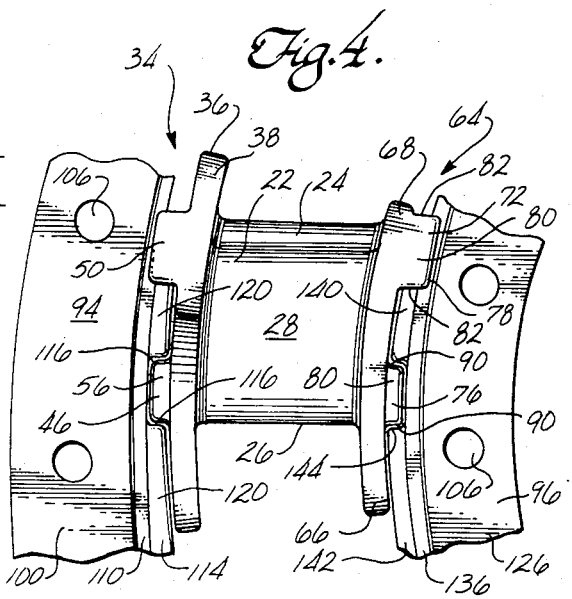
FIG. 4 is a front view of a portion of the stator nozzle of the present invention.
Figure 6:
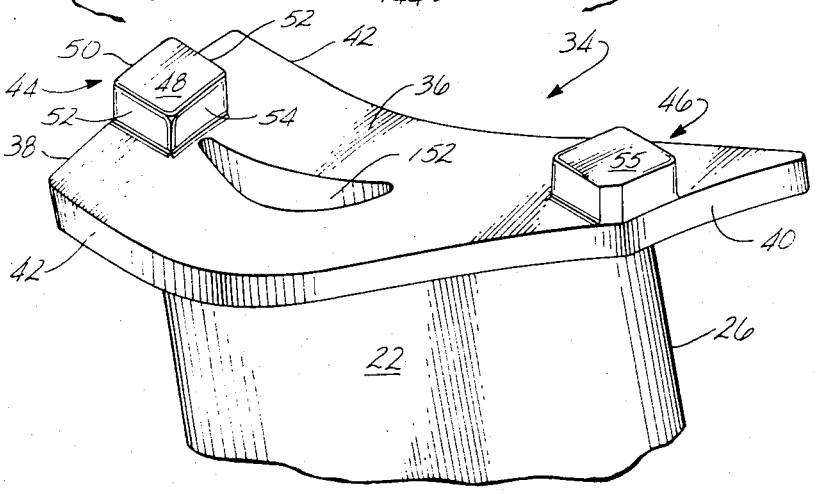
FIG. 6 is a perspective view of a top portion of a stator nozzle vane.

To provide a means for supporting the vanes 20 in the turbo-compressor 10, so as to eliminate external loading on the vane and to evenly distribute reaction forces, each vane 20 has an outer end 34 as best shown in FIGS. 2, 3 and 6. The outer end 34 includes an outer plate 36 connected to the body 22 which, when viewed axially as in FIG. 4, is curved along an arc coaxial with the center line of the turbo-compressor 10. When viewing the outer plate 36 from the radial direction, as in FIG. 3, the outer plate 36 is cuspidal having a front 38 and rear 40, both disposed in planes transverse to the center line turbo-compressor, and substantially arcuate sides 42 extending therebetween. The sides 42, for the most part, are spaced from and parallel to the first and second vane surfaces 28 and 30. Sides 42 of the outer plate 36 are adapted to mate with the sides 42 of adjacent vanes 20 to stack or book the vanes 20 together in an annular fashion about the center line of the turbo-compressor 10 as shown in FIGS. 2 and 3 while permitting individual or groups of vanes to move relative to adjacent vanes 20.

Supported by each vane outer plate 36 is a forward lug 44 (nearest the inlet 15) and a rear lug 46 (FIGS. 2, 3 and 6). The forward lug 44 has generally a cubic configuration, having a top 48 spaced from the outer plate 36 by front, side and rear walls 50, 52 and 54 respectively. Forward lug 44 is positioned on the outer plate 36 such that the front wall 50 is coplaner with the front 38 of the outer plate 36. Additionally, as shown in the drawings the rear wall 54 lies substantially in a plane which is transverse to the center line of the turbo-compressor 10. While the rear wall 54 is shown as being planar and parallel to the front wall 50, it is to be understood that it may be arcuate. As can further be seen in FIG. 3, the center of the forward lug 44 is in substantial alignment with the leading surface 24.

The rear lug 46 is also substantially cubicle and, like the forward lug 44, projects radially outward from the outer plate 36. As seen in FIG. 3, the rear lug 46 has a top 55 and a front, side, and a rear wall 56, 58 and 60 respectively, the rear wall 60 being arranged to be coplaner with the rear 40 of the vane 20. The front and rear walls 56 and 60 are parallel to one another and lie in planes transverse to the center line of the turbo-compressor 10 when the vanes 20 are disposed annularly in the turbo-compressor 10. The sidewalls 58 are disposed substantially in a pair of radial planes projecting from the center line. A bevel 62 coplaner with the side 42 of the outer plate 36 on the rear lug 46 confines the extremeties of the rear lug 46 to the envelope of the outer plate 36 to enhance the ease of manufacture of the vane 20 and remove any needless corners where stress may concentrate.

Opposite the outer end 34, each vane 20 has an inner end 64 substantially identical to the outer end 34. The inner end 64 includes an inner plate 66 which, as shown in FIGS. 2 and 4, when viewed axially, lies along an arc coaxial with the center line of the turbo-compressor 10. When viewed from the radial direction, the inner plate is cuspidal in shape having a front 68 coplaner with the front 38 of the outer plate 36, a rear 70 coplaner with the rear 40 of the outer plate 36 and arcuate sides 72 which represent radial projections toward the center line of the sides 42 of the outer plate 36. Similar to the outer end 34, the inner end 64 has forward and rear lugs 74 and 76 identical to the above described forward and rear lugs 44 and 46. The forward lug 74 has a bottom 78 spaced from the inner plate 66 by front, side and rear walls 80, 82 and 84 respectively; the front wall 80 being disposed in the same plane as the front 68. The rear wall 84 lies in substantially the same plane as the rear wall 54 of the forward lug 44 of the outer plate 36. The rear lug 76 has a bottom 86 spaced from the inner plate 66 by front, side and rear walls 88, 90 and 92 respectively. The side walls 90 are arranged along the radially projecting planes extending from the sidewalls 58 of the outer-end rear lug 46 to the center line.

To cooperate with the forward and rear lugs to define the vane support means, the stator nozzle 12 includes outer and inner rings 94 and 96 secured to the turbo-compressor housing 14 as shown in FIG. 1. The outer ring 94 has a sleeve portion 98 disposed coaxially with the center line of the turbo-compressor 10. The sleeve portion 98 is provided along its outer surface with a circumferentially extended boss 102 adapted to mate with a circumferentially extended recess 104 in the housing 14 to restrain the axial movement of the circumferentially extended outer ring 94. To secure the outer ring 94 to the housing 14, a radially outwardly projecting rim 100 is provided with a plurality of circumferentially spaced holes 106 adapted to register with threaded bores 108 in the housing 14. Bolts or the like, passing through the holes 106 and threaded into bores 108, firmly secure the outer ring 94 to the housing 14. The outer ring 94 may be of one piece construction, however, multi-piece construction can also be used.

The outer ring sleeve portion 98 includes a circumferentially extended forward shoulder 110. The forward shoulder 110 is spaced axially rearward of the rim 100 to define a circumferentially extended seat 112. Seat 112 is adapted to be closely spaced from and to loosely receive the forward lugs 44 which abut the shoulder 110. As seen in FIG. 1, the forward shoulder 110 projects radially inward from the sleeve portion 98 such that the seat 112 is L-shaped in the cross section. As can be appreciated from FIGS. 1 and 4, the forward shoulder 110 is spaced from the outer plate 36 to define a series of passageways 120 disposed between the forward lugs 44 of the vane outer ends 34.

Figure 5:
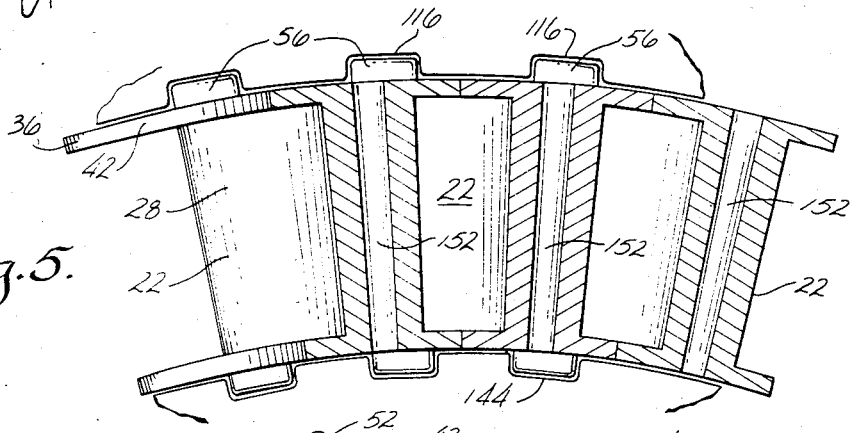
FIG. 5 is a view of the stator nozzle vanes taken along line 5—5 of FIG. 3.

At the rear of the sleeve portion 98 is a rear shoulder 114 which similarly projects radially inward from the sleeve portion 98. The rear shoulder 114 is designed to extend to a position to be closely spaced from the outer plate 36 of the vanes 20. To accommodate the rear lugs 46 of the outer end 34, the rear shoulder 114 is provided with a series of notches 116 (FIG. 5) having a width to loosely receive and confine the rear lugs 46 and a depth to be closely spaced from the top 53 of the rear lug 46. As can be seen in FIG. 1, the space between the forward and rear shoulders 110 and 114 defines a chamber 118, the purposes of which will hereinafter become evident. The chamber 118 is in communication with the passageway 120. See FIG. 2.

To support the inner end 64 of each vane 20, the stator nozzle support means includes the circumferentially extended inner ring 96. The inner ring 96 is similar to the outer ring 94 having a sleeve portion 124 and a rim 126. The sleeve portion 124 has a circumferentially extended boss 128 received by a circumferentially extended recess 129 in the housing 14 to mount the inner ring 96. The rim 126 is provided with circumferentially arranged holes 132 adapted to register with threaded bores 134 to receive mounting bolts or the like. Extending radially outward from the sleeve portion 124, the inner ring 96 has a forward shoulder 136 radially aligned with the forward shoulder 110 of the outer ring 94 to define a circumferentially extended seat 138. The seat 138 is adapted to loosely receive and confine the forward lugs 74 which abut the forward shoulder 136.

At the rear, the sleeve portion 124 has a rear shoulder 142 adapted to be closely spaced from the inner plate 66, the rear shoulder having a series of notches 144 to loosely receive and confine the rear lugs 70 of the inner end 64. As with the outer ring 94, the space between the forward and rear shoulders 136 and 142 defines a chamber 146.

Unlike the outer ring 94, the inner ring sleeve portion 124 includes a series of circumferentially spaced apertures 147 extending through the sleeve portion 124 to register with a series of outlets 150 disposed in the housing 14 and communicating with the housing space 17 for purposes which will hereinafter become evident.

As can be appreciated by viewing FIGS. 1 and 4, the vanes 20 are stacked annularly about the centerline of the turbo-compressor 10 to register with the annular inlet 15. The forward lugs 44 and 74 are positioned in their respective seats 112 and 138, the forward lugs 44 and 74 abutting foward shoulders 110 and 136 preventing the vane 20 from moving axially rearward. Since the seats 112 and 138 are spaced somewhat from the forward lugs 44 and 74, thermal expansion of the housing 14, outer or inner rings 94 and 96, or the vanes 20 does not result in compressive or tensile loading of the forward lugs 44 and 74 and the vanes 20. The rear lugs 46 and 76 are received in the notches 116 and 144 of the outer and inner rings rear shoulders 114 and 142 which confine tangential movement of the rear lugs 46 and 76. Furthermore, as discussed above with reference to the seats 112 and 138, the space between the rear shoulders 114 and 142 and the rear lugs 46 and 76 permits thermal expansion without stressing the rear lugs 46 and 76 and vanes 20.

When the turbo-compressor 10 is started and the combustion gases impinge the stator nozzle 12, the reaction force F, discussed above, is imposed upon the vane bodies 22. This force is broken down into its axial and tangential components, referred to in FIG. 3 as A and T respectively. The axial component A is loaded upon the forward lugs 44 and 74 which, in turn, transmit the force to the forward shoulders 110 and 136 and to the housing 14. The tangential force T is loaded upon the rear lugs 46 and 76 which, in turn, is transmitted to the rear shoulders 114 and 142 of the outer and inner rings 94 and 96 and to the housing 14.

Should the outer and inner rings 94 and 96 become axially or circumferentially misaligned, either due to inexact manufacturing tolerances or thermal expansion of the housing 14 or the rings themselves, such misalignment would, absent the support means according to the present invention, tend to induce external loading upon the vanes and would result in the unequal distribution of reaction forces upon the vanes. However, by virtue of the support means, misalignment of the outer and inner rings 94 and 96 will not produce such external loads upon the vanes. Axial misalignment will cause the vanes to adjust such that the forward lugs freely rock within their respective seats whereas the rear lugs pivot within the notches. Circumferential misalignment will cause the forward lugs freely pivot within their seats while the rear lugs rock within the notches. Furthermore, the adjustment of the vanes in the event of misalignment of the outer and inner rings maintains the equal distribution of the forces A and T between the forward lugs and rear lugs respectively. The axial force A will be equally loaded upon the forward lugs 44 and 74 while the tangential force T will be equally loaded upon the rear lugs 46 and 76. Accordingly, misalignment of the rings does not produce external loads upon the vanes and the components of the reaction force do not become concentrated but rather remain equally distributed between the pairs of forward and rear lugs. In essence, the support means provides a floating support of the vanes 20 permitting individual or groups of vanes 20 to adjust axially or tangentially in response to misalignment of the outer and inner rings 94 and 96 to maintain equal loading on the lugs.

As set forth above, the turbo-compressor 10 receives exhaust gases at elevated temperatures on the order of 2040° F. (2500° R.). When the rocket engine is started, the stator nozzle 12, which is at ambient temperature, is introduced to the hot exhaust gases. Due to the thickness of the vanes 20, thermal stresses are produced between the inside and outside surfaces 28 of the vanes 20 and more particularly, its body 22. These thermal stresses are proportional to the differential temperature between the interior and exterior of the vanes 20 and can be expressed according to the equation:

$$\text{Thermal Stresses} = (L\alpha\Delta T)/2$$

wherein in L is the thickness of the vane body, $\Delta T$ is the temperature differential between the interior and exterior of the vane and "$\alpha$" is the thermal coefficient of expansion of the material. These thermal stresses, due to the large temperature differentials, have tended to result in failures of stator nozzle vanes 20 heretofore found in the prior art.

Another condition, at which the thermal stresses are most pronounced, is when the rocket engine is quenched with a cryogenic gas, typically at a temperature of −380° F. (80° R.) at shut-down. The stator nozzle 12 which, just prior to quenching, is at a temperature of about 2040° F. (2500° R.), is suddenly subjected to the quenching temperature of −380° F. (80° R.). Again, the extreme temperature differential creates thermal stresses which heretofore have caused prior vanes to fail after, at best, only several cycles of start-up and shut-down.

To minimize the thermal stresses on the vanes 20, each vane, as seen in FIGS. 2, 3, 5 and 6, is provided with a hollow core 152. The core 152 extends longitudinally through the vane body 22 and outer and inner plates 34 and 64. In cross section the core 152 is somewhat elliptical so as to be spaced from but follow the first and second vane surfaces 28 and 30.

When the vanes 20 are booked in the housing, the core of each vane 20 registers with the chambers 118 and 146. When gas enters the inlet 15, be it hot exhaust gases or cryogenic gas, a portion of the gas stream passes through the passageways 120 into the chamber 118. To prevent gas from flowing rearwardly out of the chamber 118 past the rear lugs 46, a suitable ring seal 203 may be provided to overlay and seal any openings between the vanes 20 and the rear shoulder 114. Additionally, to prevent gas from flowing directly into the chamber 146 a ring seal 205 (FIG. 1) may be disposed to overlay the forward lug 74 and rim 126. From the chamber 118, the gas flows through the core 152 and exits from the vane 20 at the chamber 146. From the chamber 146, the gas is discharged into the rotor space through the aperture 147 and outlet 150. Alternatively, gas outlet passages may be created in the rear shoulder 142.

As can be appreciated, in the design of a stator nozzle the temperature differential in the thermal stress equation can the considered as a constant. That is, given the operational characteristics of the rocket engine, the temperature differentiation between the temperature at the outside of the vanes, i.e., gas temperature, and the temperature within the body of the vane, cannot be altered by design of the vane. However, by providing the core 152 which is also at the gas temperature L, the thickness of the vane between the core 152 and the first and second vane surfaces 28 and 30, is substantially reduced in relation to prior art vanes. Accordingly, the thermal stresses generated in the vanes 20 are likewise proportionately and substantially reduced. It is to be noted that the reduction of thermal stress is automatic and occurs with each and every start-up and shut-down cycle.

Since the vanes 20 are supported in such a manner that misalignment of the vane supports does not result in the uneven distribution of the reaction force on the vanes 20, bending and compressive forces, are avoided and the thermal stresses have been reduced by virtue of the cores 152, the service life of the vanes can be substantially increased. Furthermore, the vanes 20 may be constructed from materials such as injection-molded silicon nitride ceramic as well as injection-molded cast or machine refactory metal such as columbium or of a cast or machined super-alloy such as that designated as Mar-M-247. The injection-molded silicon is typically manufactured by incorporating silicon nitride into a plastic binder, the resultant composite injected into the vane producing mold. After the vane 20 has been molded, the plastic is leached therefrom and the vane 20 is centered resulting in the ceramic, silicon nitride vane 20.

It is to be understood that what has been described is merely illustrative of the principles of the invention and that numerous arrangements in accordance with this invention may be devised by one skilled in the art without departing from the spirit and scope thereof. For example, the vanes 20 could be fashioned from any other suitable material.

What is claimed is:

1. A stator nozzle for guiding the fluid flow from a forward inlet to the blades of a turbine comprising:

a plurality of vanes arranged annularly to define the stator nozzle, each vane having a body adapted to guide fluid flow and with a substantially radially extending axis, said body disposed between outer and inner ends, each vane having a hollow core extending radially therethrough;

a forward lug disposed on and projecting outward from each of the outer and inner ends;

a rear lug disposed on and projecting outward from each of the outer and inner ends to the rear of the forward lugs;

a floating support for each vane in the turbine to permit each vane to adjust in its respective radial and tangential directions to evenly distribute loads to each forward and rear lug, the floating support including a pair of concentrically arranged annularly spaced forward shoulders, the forward shoulders spaced from the outer and inner ends and adapted to abut the forward lugs of each vane to prevent the vanes from moving rearwardly, and a pair of concentrically arranged, annularly spaced rear shoulders in the turbine, the rear shoulders having notches adapted to loosely receive the rear lugs of each vane to confine tangential movement thereof, the spaces between the forward and rear shoulders defining outer and inner chambers communicating with the vane core at the outer and inner ends of each vane, a portion of the fluid passing directly through the cores to minimize thermal stresses on the vanes; and a first ring seal for each vane adapted to overlay and seal any openings between the vane and the rear shoulder at the outer end to prevent fluid from flowing rearwardly out of the outer chamber past said rear lug.

2. The nozzle of claim 1 wherein the outer and inner ends of each vane are adapted to mate with the outer and inner ends of adjacent vanes to permit the vanes to be stacked in an annular fashion and to space the vane bodies to guide fluid flow.

3. The nozzle of claim 2 wherein the outer and inner ends are cusp-shaped having arcuate sides adapted to mate with the arcuate sides of adjacent vane outer and inner ends.

4. The nozzle of claim 1 wherein the forward lugs each have a rear face adapted to abut the forward shoulders, the rear faces of the forward lugs of each vane arranged substantially in the same plane.

5. The nozzle of claim 4 wherein the rear faces of the forward lugs of each vane are arranged substantially in the same plane normal to the center line axis of the shaft.

6. The nozzle of claim 1 wherein the rear lugs each have sidewalls adapted to abut the confines of the notches, the sidewalls of the rear lugs of each vane being disposed substantially in the same radial planes.

7. The nozzle of claim 1 wherein the vanes are made of a ceramic material.

8. The nozzle of claim 1 further including a second ring seal for each vane adapted to overlay and seal any openings between said forward lug projecting from the inner end and said floating support to prevent fluid from flowing directly into said inner chamber from said forward inlet.

9. An improved turbine of the type having a housing, a shaft rotatably disposed in the housing and mounting at least one rotor having a plurality of rotor blades and a forward inlet to admit fluid flow to the rotor blades, the improvement comprising:

a stator nozzle including a plurality of vanes arranged annularly about the shaft, each vane having a body to guide fluid flow to the rotor blades and extending between outer and inner ends, each vane having a hollow core extending radially therethrough, and a forward lug and a rear lug disposed on each of the outer and inner ends to support each vane;

a floating support for each vane to permit each vane to adjust in radial and longitudinal directions with respect to the shaft to evenly distribute loads to the forward and rear lugs, the floating supports including annularly spaced forward shoulders in the housing to abut the forward lugs and prevent rearward movement of the vanes and annularly spaced rear shoulders having notches adapted to loosely receive the rear lugs to restrict tangential movement of each vane, spaces between the forward and rear shoulders defining outer and inner chambers communicating with the vane core at the outer and inner ends of each vane, a portion of the fluid passing through the cores to minimize thermal stresses on said vanes; and a first ring seal for each vane adapted to overlay and seal any openings between the vane and its rear shoulder at the outer end to prevent fluid from flowing rearwardly out of the outer chamber past the rear lug.

10. The turbine of claim 9 wherein the outer and inner ends of each vane are adapted to mate with the outer and inner ends of adjacent vanes to annularly stack the vanes and space the vane bodies for guiding fluid flow.

11. The turbine of claim 10 wherein the outer and inner ends each have arcuate sides adapted to mate with the sides of adjacent vane outer and inner ends.

12. The turbine of claim 9 wherein the forward lugs are cubical having a rear face, the rear faces of the forward lugs of each vane disposed in substantially the same plane.

13. The turbine of claim 12 wherein the forward lug rear faces are arranged in substantially the same radial plane with respect to the shaft axis.

14. The turbine of claim 9 wherein the rear lugs are cubical having forward to rear extended sidewalls adapted to abut the confines of the receiving notches, the sidewalls of the rear lugs arranged in substantially the same planes.

15. The turbine of claim 14 wherein the sidewalls are arranged in substantially the same planes projecting radially from the shaft axis.

16. The turbine of claim 9 wherein the floating support includes an outlet to pass the fluid from the vane cores to the rotor blades.

17. The turbine of claim 9 further including a second ring seal for each vane adapted to overlay and seal any openings between said forward lug disposed on the inner end and said floating support to prevent fluid from flowing directly into said inner chamber from said forward inlet.

* * * * *